US009849490B2

(12) United States Patent
Krämer et al.

(10) Patent No.: US 9,849,490 B2
(45) Date of Patent: Dec. 26, 2017

(54) DEVICE AND CLEANING UNIT FOR CLEANING A GLUE ROLLER OF A LABELING STATION

(71) Applicant: KHS GmbH, Dortmund (DE)

(72) Inventors: Klaus Krämer, Dortmund (DE); Lutz Deckert, Haltern am See (DE)

(73) Assignee: KHS GmbH, Dortmund (DE)

( * ) Notice: Subject to any disclaimer, the term of this patent is extended or adjusted under 35 U.S.C. 154(b) by 30 days.

(21) Appl. No.: 14/917,122

(22) PCT Filed: Aug. 19, 2014

(86) PCT No.: PCT/EP2014/067612
§ 371 (c)(1),
(2) Date: Mar. 7, 2016

(87) PCT Pub. No.: WO2015/036203
PCT Pub. Date: Mar. 19, 2015

(65) Prior Publication Data

US 2016/0214151 A1 Jul. 28, 2016

(30) Foreign Application Priority Data

Sep. 11, 2013 (DE) ..... 10 2013 109 999

(51) Int. Cl.

| | |
|---|---|
| ***B65C 9/08*** | (2006.01) |
| ***B08B 13/00*** | (2006.01) |
| ***B65C 9/00*** | (2006.01) |
| ***B65C 9/20*** | (2006.01) |
| ***A47L 7/00*** | (2006.01) |
| ***B08B 1/00*** | (2006.01) |
| ***B08B 3/04*** | (2006.01) |

(52) U.S. Cl.
CPC ..... *B08B 13/00* (2013.01); *A47L 7/0004* (2013.01); *B08B 1/002* (2013.01); *B08B 1/005* (2013.01); *B08B 3/04* (2013.01); *B65C 9/00* (2013.01); *B65C 9/20* (2013.01)

(58) Field of Classification Search
CPC ..... A47L 7/004; B08B 13/00; B08B 1/005; B08B 3/04; B08B 1/002; B65C 9/20; B65C 9/08
USPC ..... 15/301, 303
See application file for complete search history.

(56) References Cited

FOREIGN PATENT DOCUMENTS

| | | |
|---|---|---|
| DE | 11 36 629 | 9/1962 |
| DE | 20 2005 002793 | 4/2005 |
| DE | 10 2006 013 844 | 10/2007 |
| DE | 10 2008 023 265 | 11/2009 |
| DE | 20 2012 003 268 | 5/2012 |
| DE | 10 2011 002 590 | 7/2012 |
| EP | 2 296 984 | 3/2011 |
| EP | 2 476 624 | 7/2012 |
| EP | 2 610 192 | 7/2013 |
| WO | WO 2009/155970 | 12/2009 |

*Primary Examiner* — David Redding
(74) *Attorney, Agent, or Firm* — Occhiuti & Rohlicek LLP

(57) ABSTRACT

An apparatus for cleaning a surface of a glue roller of a labeling station that applies labels to containers includes a modular cleaning unit that one can insert into the apparatus to displace at least one segment of a multi-segment vacuum drum.

22 Claims, 5 Drawing Sheets

DEVICE AND CLEANING UNIT FOR CLEANING A GLUE ROLLER OF A LABELING STATION

RELATED APPLICATIONS

This is the national stage of international application PCT/EP2014/067612, filed on Aug. 19, 2014, which claims the benefit of the Sep. 11, 2013 priority date of German application DE 102013109999.8, the contents of which are herein incorporated by reference.

FIELD OF INVENTION

The invention relates to labeling containers, and in particular, to cleaning a glue roller.

BACKGROUND

Labeling machines often have a glue roller that spreads hot glue on labels. The glue roller typically has a knurled surface with indentations. Eventually, these indentations will fill with an amalgam of dried glue and label fragments. As a result, it is important to regularly clean these indentations.

A difficulty that arises is that because of the glue's viscosity, it is only practical to move the roller for cleaning when it is very hot. Otherwise, the viscosity of any glue left on the roller will resist movement. This means that cleaning takes place while the roller is hot.

Known cleaning methods are manual. Since the cleaning takes place at high temperature, there is a significant danger of burns. Not surprisingly, maintenance personnel are reluctant to carry out this task. As a result, cleaning is often postponed until labeling performance has degenerated to the point of being intolerable.

Another disadvantage during manual cleaning of the glue roller by means of mechanical aids, such as, for example, brushes, blades, needles, etc., is that the surface of the glue roller may incur damage.

In addition, the task of manually cleaning glue rollers is time-consuming. This results in lengthy machine shutdown times, which increase cost.

SUMMARY

Among the objects of the invention is that of providing an apparatus that cleans a glue roller of a labeling station that applies labels to containers or bottles. Another object of the invention is that of providing a modular cleaning unit for use in such an apparatus.

A major aspect of an apparatus according to the invention is that of a modular cleaning unit for cleaning the glue roller. Such a module can be inserted into the carrier unit instead of at least one part or segment of the vacuum drum. This transforms the task of cleaning a glue roller from a tedious and dangerous task into a simple and rapid that requires a minimum of human intervention. This reduces the risk of personal injury and avoids lengthy periods in which the labeling machine stands idle as a result of having to have its glue roller cleaned. The apparatus also yields a consistently good cleaning quality. Moreover, using the apparatus means that the glue roller can be cleaned while it is still very hot, and in fact hotter than what a human cleaner can safely handle. Since human intervention is minimal to non-existent, the use of the apparatus reduces the risk of accidents that may injure operating personnel.

In one aspect, the cleaning unit comprises at least one cleaning tool that is designed for the at least sectional cleaning of the surface of the glue roller. To further advantage, the cleaning tool is designed for pressing against the glue roller's surface. The pressure can come arise mechanically or from fluid pressure.

Embodiments of the cleaning tool include a cleaning nozzle element, a brush element, a scraper element, or combinations thereof. A cleaning unit can have more than one such cleaning tool. These cleaning tools are accommodated in a replaceable manner in the cleaning unit. The cleaning unit can therefore be adjusted to the particular cleaning tasks required by swapping the relevant tools in and out of the cleaning unit.

In some embodiments, the cleaning unit and/or the cleaning tools are heatable, or self-heating. The application of heat makes it much easier to release debris from the glue roller's surface. For example, a heated scraper in direct contact with the glue roller's surface will soften any hardened adhesive on the surface, thus making it easier to remove.

In some embodiments, the cleaning unit includes a suction device for extracting or sucking materials such as fluids, glue residues, label residues, or combinations thereof. Suitable suction devices include a cleaning nozzle unit that is arranged upstream and/or downstream. Using such nozzles, it is possible to suck used cleaning fluid and deliver it back to be used again for cleaning.

In some embodiments, the cleaning unit includes a delivery device, such as a delivery pump, for dispensing a cleaning fluid onto the cleaning tools. In these embodiments, it is possible to integrate some sort of dispensing device directly into the cleaning unit for conducting cleaning fluids to a nozzle. Preferably, the cleaning fluid is pressurized.

In one embodiment, a plurality of cleaning modules is inserted into the cleaning unit. Each cleaning module carries out one cleaning step. These modular cleaning modules can thus be mixed and matched to suit the particular cleaning task at hand.

Further embodiments include those in which an accommodation container holds cleaning fluid. In this way, the cleaning fluid can be accommodated in the cleaning unit itself instead of being delivered from an external source. This results in an autonomous cleaning unit.

The cleaning unit can be stationary, or it can pivot about a longitudinal axis running parallel to the roller axis of the glue roller. The glue roller can preferably be driven such as to rotate about its roller axis, and the carrier unit about a vertical axis that is preferably parallel to the roller axis.

In some embodiments, the carrier unit is shaped like a plate or a circular disk. Additionally, the carrier unit and/or the cleaning unit can be connected to a drive shaft that drives the vacuum drum. The modular cleaning unit can therefore be located without any problem onto the carrier unit or the drive shaft.

In one aspect, the invention features an apparatus for cleaning a surface of a glue roller of a labeling station that applies labels to containers. The apparatus includes a modular cleaning unit that one can insert into the apparatus to displace at least one segment of a multi-segment vacuum drum.

In some embodiments, the apparatus includes a carrier unit that is spaced from the glue roller's surface. The carrier unit receives some but not all segments of a multi-segment vacuum drum that is operatively connected to the glue roller, as well as the cleaning unit. In particular, the cleaning unit displaces one or more segments of the vacuum drum.

In some of these embodiments, the carrier unit is configured to rotate about a vertical axis thereof.

In others, the carrier unit is either a plate or a circular disk.

Also among the embodiments are those in which either the carrier unit or the cleaning unit connects to a drive shaft that drives the vacuum drum.

In yet other embodiments, the cleaning unit is self-heating.

Other embodiments include those that have at least one cleaning tool configured for step-by-step cleaning of the surface. Among these are embodiments in which the cleaning tool applies a pressure force against the surface, those in which it is self-heating, and those in which it includes a cleaning nozzle, a brush, a scraper, or any combination thereof.

In those embodiments that have a cleaning tool, some means for delivering cleaning fluid to the tool is provided. These include a dispensing device or delivery pump. The fluid itself can be a cleaning fluid, a cleaning agent, a solvent, a cleaning solution, or any combination thereof.

In other embodiments, the cleaning unit includes a suction device that sucks material from the surface of the glue roller. Such materials include fluid, glue residue, label residue, or combinations thereof.

Yet other embodiments include multiple cleaning modules, each of which carries out a cleaning step.

In other embodiments, the cleaning unit includes an accommodation holder for holding a cleaning fluid.

Embodiments include those in which the glue roller rotates about a roller axis. Among these are embodiments in which the cleaning unit is stationary so that the glue roller moves relative to the cleaning unit.

In yet other embodiments, the cleaning unit engages in motion about a vertical axis that runs parallel to a roller axis of the glue roller. Such movement includes pivoting, rotating, rolling, and any combination thereof.

As used herein, "cleaning fluid" includes cleaning agents, solvents, cleaning solutions, and combinations thereof.

As used herein, terms such as "essentially" or "approximately" or "some" or "approx." refer to deviations from an exact value of ±10%, preferably by ±5% and/or deviations that are of no significance to function.

Further embodiments, advantages, and possible applications of the invention are also derived from the following description of embodiments and from the figures. In this context, all the features described and/or represented in figures are, alone or in any desired combination, in principle the object of the invention, regardless of their summary in the claims or reference to them. The content of the claims is also deemed a constituent part of the description.

BRIEF DESCRIPTION OF THE DRAWINGS

These and other features of the invention will be apparent from the following detailed description and the accompanying figures, in which.

DETAILED DESCRIPTION

Figure 1:
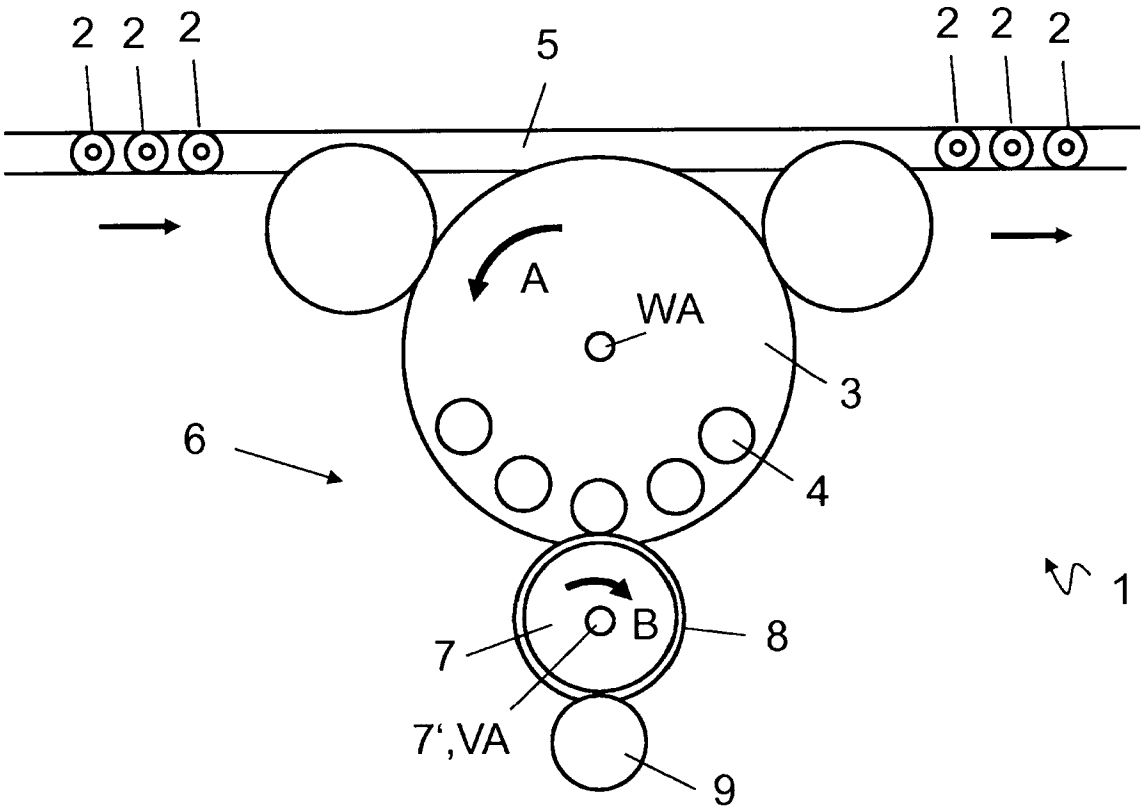
FIG. 1 shows a top view of a labeling station.

FIG. 1 shows a top view of a labeling device 1 formed as a rotating machine. The labeling device 1 applies labels, for example wrap-around labels, onto containers or bottles 2. It is understood that the invention is by no means restricted to labeling devices 1 for the application of wrap-around labels, but can be used for a plurality of labeling devices 1.

The labeling device 1 includes a rotor 3 that rotates about a vertical machine axis in a rotation direction A. Along the periphery of the rotor 3 are rotating plates 4 on which bottles 2 to be labeled stand. A transporter 5 brings bottles 2 to a bottle inlet of the rotor 3 in such a way that bottles 2 stand upright on corresponding rotating plates 4 with their respective bottle axes oriented in the vertical direction.

The rotor 3 moves the bottles 2 past a labeling station 6. Meanwhile, a drive shaft 7' connected to the carrier unit 8 rotates a carrier unit 8 about its vertical axis VA in synchrony with the rotor 3. The carrier unit 8 is typically a plate or a circular disk.

The carrier unit 8 carries a vacuum drum 7 having a lateral surface that holds labels. The vacuum drum 7 transfers a preceding label end of the label to a bottle 2 as the bottle 2 moves past it. These labels are all glued on their reverse sides. As the bottle 2 rotates, it draws the label off the vacuum drum 7 and winds it around itself with the reverse side of the label oriented to stick to the bottle 2. This results in a wrap-around label. The rotor 5 then carries the now-labeled bottles 2 back to the transporter 5 via a bottle outlet to be transported away.

The vacuum drum 7 is preferably a multiple-piece having a plurality of segments and a circular disk-shaped cover. The segments collectively form the vacuum drum's lateral surface. The circular disk-shaped cover forms its upper surface. Clamps secure the cover to an upper end of the drive shaft 7'. As a result of being coupled to the drive shaft 7', the vacuum drum rotates about the vertical axis VA in synchrony with the rotor 3 but in the opposite direction B.

Figure 3:
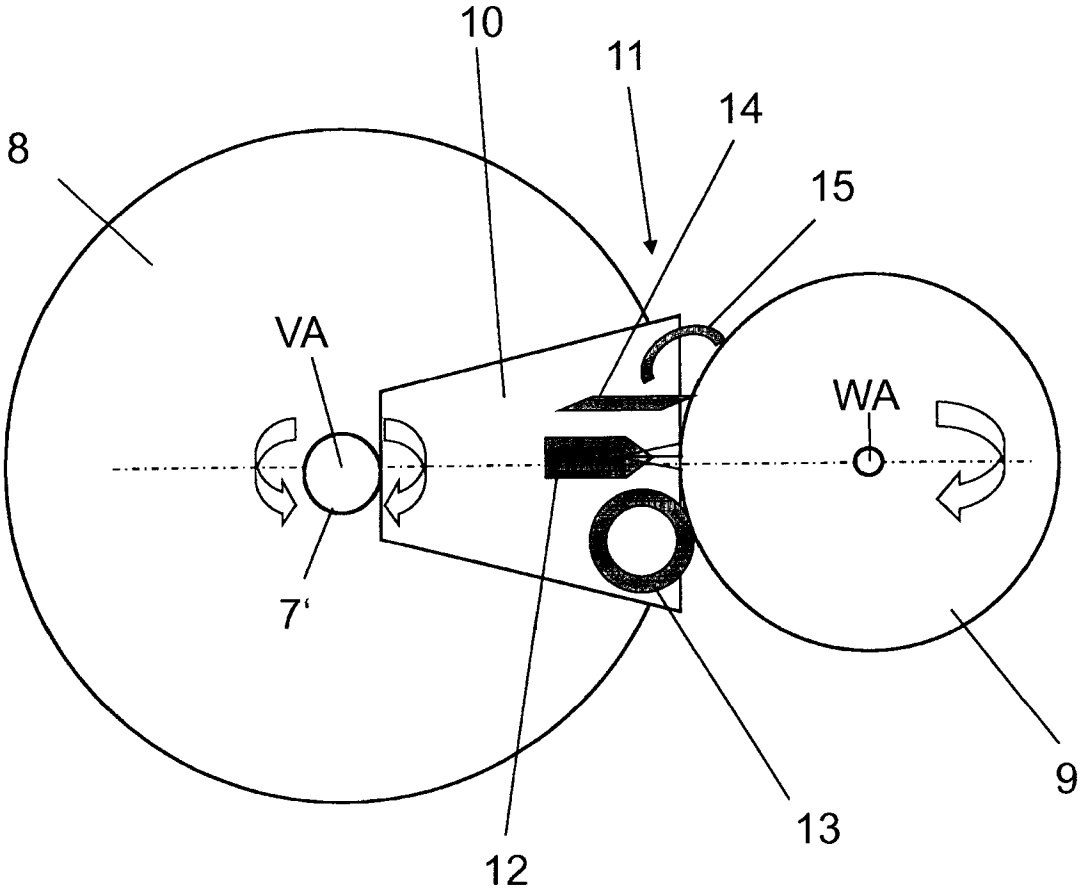
FIG. 3 shows a top view of an alternative embodiment of a cleaning unit.

Vacuum holders or vacuum pads hold the labels against the lateral surface. The drum 7 also has a glue roller 9 that can be heated. Referring to FIG. 3, a drive shaft rotates the glue roller 9 about a roller axis WA thereof that runs parallel to the vertical axis VA.

A cleaning unit 10 cleans the glue roller 9. The cleaning unit 10 is a module that can be inserted into the carrier unit 8 in place of a segment of the vacuum drum 7, thereby displacing that segment. Preferably, the cleaning unit 10 can be connected to the drive shaft 7' in such a way that the cleaning unit 10 is either stationary in relation to the glue roller 9 or on the carrier unit 8 so as to pivot about the vertical axis VA of the carrier unit 8.

The cleaning unit 10 can be inserted rapidly and easily into the carrier unit 8 after at least partially removing the vacuum drum 7 to begin automatically cleaning the glue roller 9. A control unit actuates the cleaning unit 10 and/or the drive shaft 7' that drives the carrier unit 8.

The cleaning unit 10 includes at least one cleaning tool 11 for at least sectional cleaning of glue roller's surface. In some embodiments, the cleaning tool 11 is exchangeable.

Preferably, the cleaning tool 11 applies a pressure force on the surface of the glue roller 9. This pressure force originates either from fluid pressure or mechanical pressure. The cleaning tool 11 is arranged on an outer side of the cleaning unit 10 that is oriented towards to the glue roller 9. Depending on the cleaning step being carried out by the cleaning unit 10, the cleaning tool 11 leaves a gap between itself and an outer side in the direction of the glue roller 9.

In some embodiments, the cleaning tool 11 has a nozzle 12. Preferably, the nozzle 12 extends along a longitudinal axis of the cleaning unit 10. In operation, the nozzle 12 conducts pressurized cleaning fluid towards the surface to be cleaned. In some embodiments, the nozzle 12 pivots or rotates about an axis in the cleaning unit 10, preferably oriented perpendicular towards the outer side of the cleaning unit 10. A drive shaft 7' activates the nozzle 12 either directly or indirectly. Alternatively, individually actuatable drive units activate the nozzle 12. These drive units can be either hydraulically operated motors or electrically operated motors.

In some embodiments, the cleaning tool 11 has a brush 13. A suitable brush 13 is a circular brush accommodated in the cleaning unit 10 so as to rotate or pivot about axes of rotation running parallel to the vertical axis VA. Either the drive shaft 7' or individually allocated drive units drive the brush elements 13.

In some embodiments, the cleaning tool 11 has a scraper 14 that forms a free scraping edge. When the scraper 13 presses against the glue roller 9 with a predetermined pressure force, it scrapes the glue roller 9 clean. The scraper 14 can be upstream or downstream of a cleaning nozzle unit 12 and/or a brush element 13.

Figure 2:
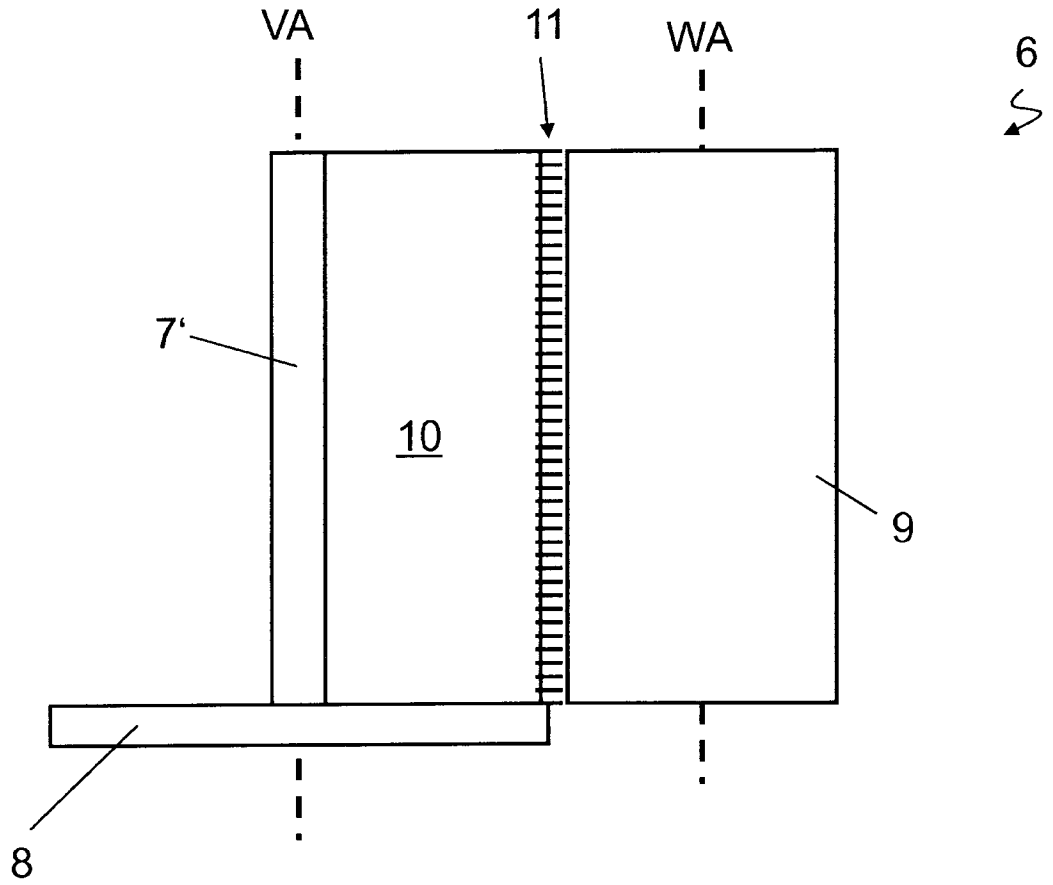
FIG. 2 shows a side view of an alternative embodiment of a cleaning unit with a glue roller mounted on a carrier unit.

Represented by way of example in FIG. 2 is a schematic side view of a cleaning unit 10 accommodated on the carrier unit 8 next to a glue roller 9 that is to be cleaned. In FIG. 2, the cleaning unit 10 the cleaning tool 11 has a brush element 13.

FIG. 3 shows a top view of a cleaning unit 10 on a carrier unit 8 that operatively connects to a glue roller 9 that is to be cleaned. In this embodiment, the cleaning unit 10 has several cleaning tools 11, namely a cleaning nozzle 12, a brush 13, and a scraper 14.

In some embodiments, the cleaning unit 10 is a self-heating cleaning tool 11 that can be heated to a temperature sufficient to substantially reduce the viscosity of the glue.

Other embodiments feature a suction device 15 for sucking fluids, glue residues, and/or label residues. Preferably, the suction device 15 is in the immediate vicinity of the cleaning tools 11.

In another embodiment, the cleaning unit 10 includes a dispensing device, such as a delivery pump, for providing cleaning fluid to the cleaning tools 11, and in particular, to the nozzle 12. The source of fluid can be outside the cleaning unit 10. However, it is also possible for the cleaning unit 10 to have a container for containing cleaning fluid.

Figure 4:
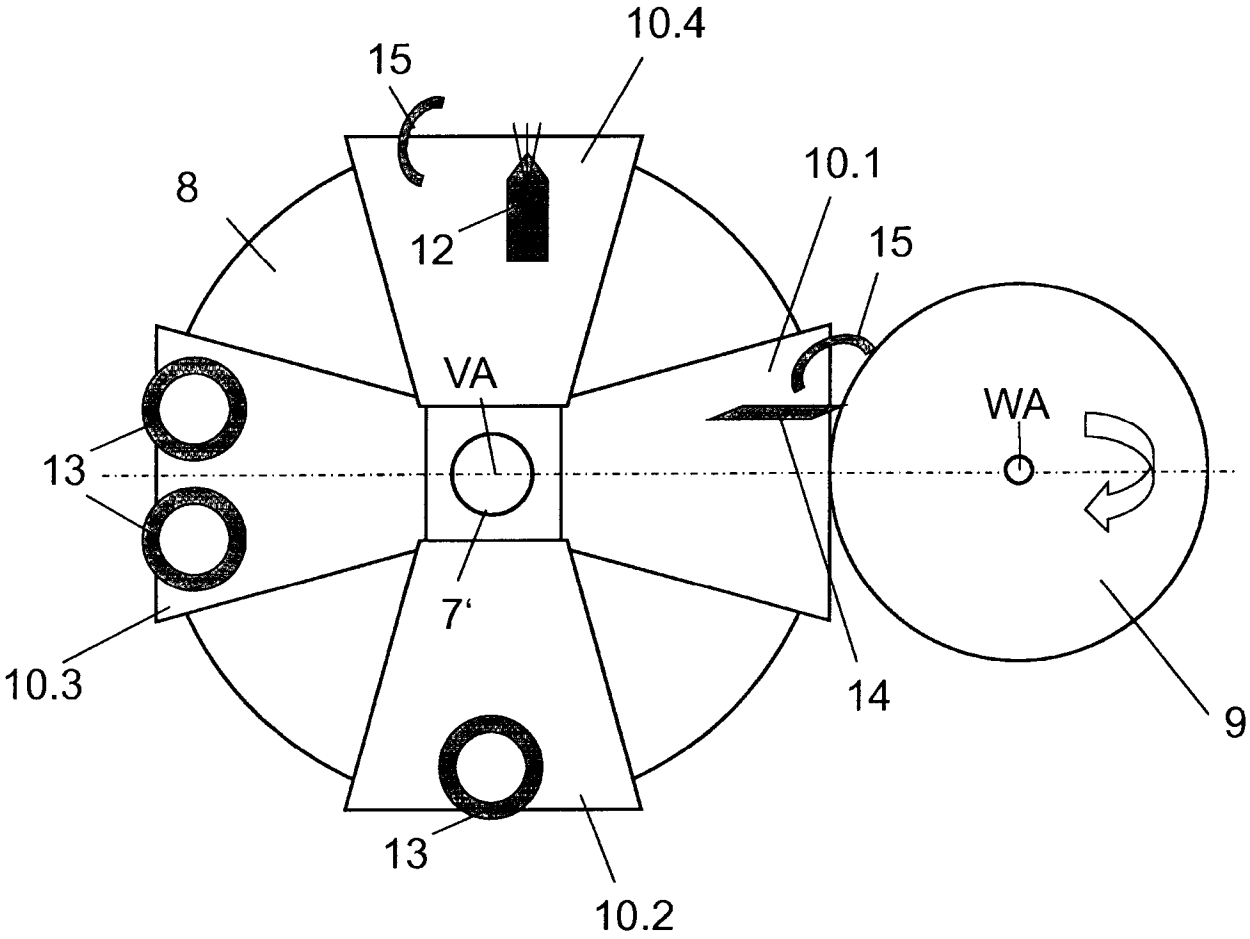
FIG. 4 shows a top view of a cleaning unit with more than one cleaning module.
Figure 5:
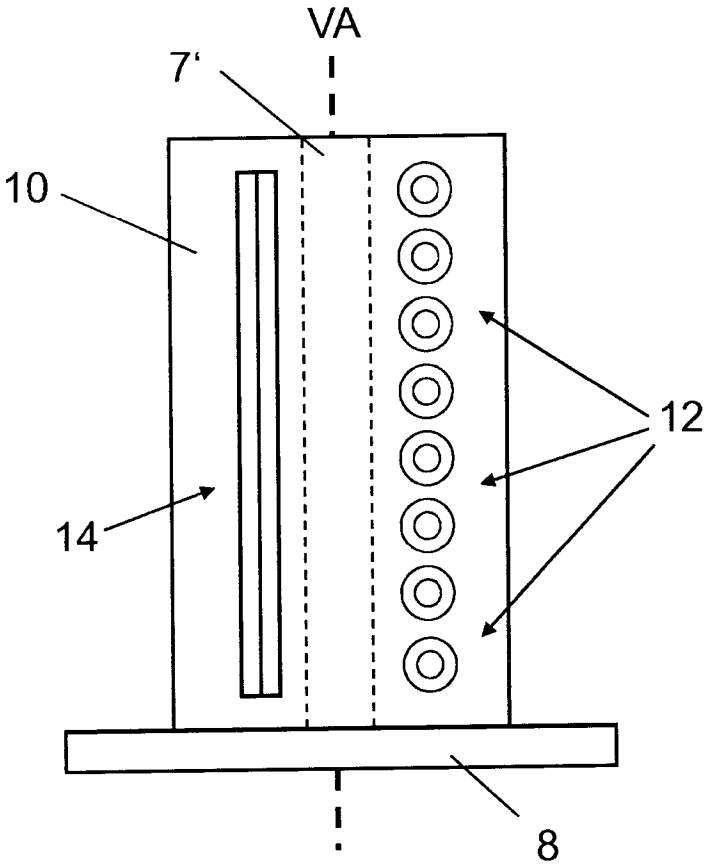
FIG. 5 shows a side view of a cleaning unit facing a glue roller.

FIG. 4 shows an embodiment in which the cleaning unit 10 is a modular structure having more than one cleaning module. In the particular embodiment shown, there are four such cleaning modules: a first cleaning module 10.1, a second cleaning module 10.2, a third cleaning module 10.3, and a fourth cleaning module 10.4. However, embodiments include those with different numbers of cleaning modules.

In the particular embodiment shown, the cleaning modules 10.1-10.4 are uniformly arranged about a vertical axis VA to form a cleaning star. Each of the cleaning modules 10.1-10.4 carries out at least one cleaning step. The cleaning modules 10.1-10.4 can therefore be arranged to carry out different cleaning tasks.

In FIG. 4, the first cleaning module 10.1 includes a scraper 14, the second cleaning module 10.2 includes a brush 13, the third cleaning module 10.3 includes a pair of brushes 13, and the fourth cleaning module 10.4 includes a nozzle 12 with a downstream suction device 15. The cleaning modules 10.1-10.4 are mounted on the carrier unit 8 and rotated about the vertical axis VA. As the carrier unit 8 rotates, it subjects the glue roller 9 to the cleaning steps carried out by the cleaning modules 10.1-10.4. Preferably, the cleaning steps occur at an elevated temperature of approximately 100° C.

The invention has been described by way of exemplary examples. It is understood that modifications or deviations are possible, without departing from the underlying idea of the invention. The invention is thus defined solely by the accompanying claims and not limited to the illustrated embodiments.

Having described the invention, and a preferred embodiment thereof, what is claimed as new, and secured by Letters Patent is:

1. An apparatus for cleaning a surface of a glue roller of a labeling station that applies labels to containers, said apparatus comprising a cleaning unit and a carrier unit, wherein said cleaning unit is configured as a module that, when inserted into said apparatus, displaces at least one segment of a multi-segment vacuum drum, wherein, during operation of said apparatus, said carrier unit is disposed to be spaced from said surface, wherein said carrier unit is configured to receive at least a portion of said multi-segment vacuum drum that is operatively connected to said glue roller, and wherein said cleaning unit is configured to be inserted into said carrier unit to displace said at least one segment.

2. The apparatus of claim 1, wherein said carrier unit is configured to rotate about a vertical axis thereof.

3. The apparatus of claim 1, wherein said carrier unit comprises a plate.

4. The apparatus of claim 1, wherein said carrier unit comprises circular disk.

5. The apparatus of claim 1, further comprising a drive shaft that drives said vacuum drum, wherein said carrier unit is connected to said drive shaft.

6. The apparatus of claim 1, wherein said cleaning unit is self-heating.

7. The apparatus of claim 1, wherein said cleaning unit comprises a cleaning tool configured for step-by-step cleaning of said surface.

8. The apparatus of claim 7, wherein said cleaning tool is configured to apply a pressure force against said surface.

9. The apparatus of claim 7, wherein said cleaning tool comprises a cleaning nozzle.

10. The apparatus of claim 7, wherein said cleaning tool comprises a brush.

11. The apparatus of claim 7, wherein said cleaning tool comprises a scraper.

12. The apparatus of claim 7, wherein said cleaning tool is self-heating.

13. The apparatus of claim 7, wherein said cleaning unit comprises a dispensing device for delivery of cleaning fluid to said cleaning tool.

14. The apparatus of claim 7, wherein said cleaning unit comprises a delivery pump for delivery of cleaning agent to said cleaning tool.

15. The apparatus of claim 1, wherein said cleaning unit comprises a suction device configured for sucking at least one of fluid, glue residue, and label residue.

16. The apparatus of claim 1, wherein said cleaning unit comprises a plurality of cleaning modules, each of which is configured to carry out a cleaning step.

17. The apparatus of claim 1, wherein said cleaning unit comprises an accommodation holder for holding a cleaning fluid.

18. The apparatus of claim 1, wherein said glue roller is configured to rotate about a roller axis thereof.

19. The apparatus of claim 18, wherein, in operation, said cleaning unit is stationary.

20. The apparatus of claim 1, wherein said cleaning unit is configured to pivot about a vertical axis running parallel to a roller axis of said glue roller.

21. The apparatus of claim 1, wherein said cleaning unit is configured to rotate about a vertical axis running parallel to a roller axis of said glue roller.

22. The apparatus of claim 1, wherein said cleaning unit is connected to a drive shaft that drives said vacuum drum.

* * * * *